US009845648B2

(12) United States Patent
Clausen

(10) Patent No.: US 9,845,648 B2
(45) Date of Patent: Dec. 19, 2017

(54) DRILL BITS WITH VARIABLE FLOW BORE AND METHODS RELATING THERETO

(71) Applicant: National Oilwell Varco, L.P., Houston, TX (US)

(72) Inventor: Jeffery Ronald Clausen, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 239 days.

(21) Appl. No.: 14/706,287

(22) Filed: May 7, 2015

(65) Prior Publication Data

US 2016/0326810 A1 Nov. 10, 2016

(51) Int. Cl.

| | |
|---|---|
| ***E21B 21/08*** | (2006.01) |
| ***E21B 10/60*** | (2006.01) |
| ***E21B 10/62*** | (2006.01) |

(52) U.S. Cl.

CPC ..... *E21B 21/08* (2013.01); *E21B 10/60* (2013.01); *E21B 10/62* (2013.01)

(58) Field of Classification Search

CPC .... E21B 10/60; E21B 2010/607; E21B 10/61; E21B 10/62; E21B 21/08; E21B 21/103

See application file for complete search history.

(56) References Cited

U.S. PATENT DOCUMENTS

| | | | | |
|---|---|---|---|---|
| 2,307,658 | A * | 1/1943 | Appleby | E21B 7/18 175/242 |
| 2,828,107 | A * | 3/1958 | Bobo | E21B 21/103 175/237 |
| 5,890,540 | A | 4/1999 | Pia et al. | |
| 2010/0252276 | A1 | 10/2010 | Clausen et al. | |
| 2012/0061148 | A1 | 3/2012 | Clausen et al. | |
| 2013/0161102 | A1* | 6/2013 | Zhou | E21B 10/60 175/267 |

* cited by examiner

*Primary Examiner* — Brad Harcourt
(74) *Attorney, Agent, or Firm* — Conley Rose, P.C.

(57) ABSTRACT

A drill bit is disclosed for drilling a borehole. In an embodiment, the bit includes a bit body having a central axis, a first end, a second end opposite the first end, and a radially outer surface. The bit body includes a flow passage extending axially from the first end, and a cutting structure disposed at the second end. In addition, the bit includes an actuating member disposed within the flow passage. The actuating member includes a throughbore, a radially outer surface, and a fluid flow port extending radially from the throughbore to the radially outer surface of the actuating member. The actuating member is configured to move axially relative to the bit body between a first position restricting fluid communication between the throughbore and the borehole through the fluid flow port and a second position allowing fluid communication between the throughbore and the borehole through the fluid flow port.

17 Claims, 7 Drawing Sheets

DRILL BITS WITH VARIABLE FLOW BORE AND METHODS RELATING THERETO

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The present disclosure relates generally to drilling systems and earth-boring drill bits for drilling a borehole for the ultimate recovery of oil, gas, and/or minerals. More particularly, the present disclosure relates to drill bits with one or more selectively engageable variable flow bores incorporated therein.

During subterranean drilling operations, an earth-boring drill bit is connected to the lower end of a drill string and is rotated by rotating the drill string from the surface, with a downhole motor, or by both. With weight-on-bit (WOB) applied, the rotating drill bit engages the formation and proceeds to form a borehole toward a target zone.

During these operations, costs are generally proportional to the length of time it takes to drill the borehole to the desired depth and location. The time required to drill the well, in turn, is greatly affected by the number of times downhole tools must be changed, added, and/or repaired during drilling operations. This is the case because each time a downhole tool is changed, added, and/or repaired, the entire string of drill pipes, which may be miles long, must be retrieved from the borehole, section-by-section. Once the drill string has been retrieved and the desired operation is complete, the drill string must be constructed section-by-section and lowered back into the borehole. This process, known as a "trip" of the drill string, requires considerable time, effort and expense. Since drilling costs are typically on the order of thousands of dollars per hour, it is desirable to reduce the number of times the drill string must be tripped to complete the borehole.

During conventional drilling operations, it is often necessary to change, replace, and/or repair the drill bit disposed at the lower end of the drill string once it has become damaged, worn out, and/or its cutting effectiveness has sufficiently decreased. Regardless of the specific motivations, each time the drill bit is changed, replaced, and/or repaired, a trip of the drill string must be performed which thus increases the overall time and costs associated with drilling the subterranean wellbore.

BRIEF SUMMARY OF THE DISCLOSURE

Some embodiments disclosed herein are directed to a drill bit for drilling a borehole in a subterranean formation. In an embodiment, the drill bit includes a bit body having a central axis, a first end, a second end opposite the first end, and a radially outer surface. The bit body includes a flow passage extending axially from the first end, and a cutting structure disposed at the second end. In addition, the bit includes an actuating member disposed within the flow passage. The actuating member includes a throughbore, a radially outer surface, and a fluid flow port extending radially from the throughbore to the radially outer surface of the actuating member. The actuating member is configured to move axially relative to the bit body between a first position restricting fluid communication between the throughbore and the borehole through the fluid flow port and a second position allowing fluid communication between the throughbore and the borehole through the fluid flow port.

Other embodiments disclosed herein are directed to a drill bit for drilling a borehole in a subterranean formation. In an embodiment, the drill bit includes a bit body having a central axis, a first end, a second end opposite the first end, and an outer surface extending from the first end to the second end. The bit body includes a central flow passage extending axially from the first end, a first fluid flow bore extending from the central flow passage to the outer surface, and a second fluid flow bore extending from the central flow passage to the outer surface. The second fluid flow bore is configured to supply drilling fluid to a cutting structure mounted to the second end of the bit body. In addition, the bit includes an actuating member movably disposed within the central flow passage. The actuating member includes a throughbore, a radially outer surface, and a fluid flow port extending radially from the throughbore to the radially outer surface of the actuating member. The actuating member is configured to move axially relative to the bit body between a first position with the fluid flow port of the actuating member out of axial alignment with the first fluid flow bore of the bit body and a second position with the fluid flow port of the actuating member at least partially axially aligned with the first fluid flow bore of the bit body. The throughbore of the actuating member is configured to supply drilling fluid to the second fluid flow bore of the bit body but not the first fluid flow bore of the bit body with the actuating member in the first position. The throughbore of the actuating member is configured to supply drilling fluid to the first fluid flow bore of the bit body and the second fluid flow bore of the bit body with the actuating member in the second position.

Still other embodiments disclosed herein are directed to a method for drilling a borehole in a subterranean formation. In an embodiment, the method includes (a) rotating a drill bit about a central axis, the drill bit including a bit body having a first end, a second end opposite the first end, a radially outer surface, a flow passage extending axially from the first end, and a cutting structure disposed at the second end. In addition, the method includes (b) flowing drilling fluid through the flow passage of the bit body during (a), and (c) axially moving an actuating member to a first position within the flow passage. The actuating member includes a throughbore, a radially outer surface, and a fluid flow port extending radially from the throughbore to the radially outer surface of the actuating member. Further, the method includes (d) restricting fluid communication between the throughbore and the borehole through the fluid flow port during (c). Still further, the method includes (e) axially moving the actuating member to a second position within the flow passage that is axially spaced from the first position, and (f) allowing fluid communication between the throughbore and the borehole through the first flow port during (e).

Embodiments described herein comprise a combination of features and advantages intended to address various shortcomings associated with certain prior devices, systems, and methods. The foregoing has outlined rather broadly features and technical advantages in order that the detailed description that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out. It should also be realized by those skilled in the art that such equivalent constructions do not depart from the spirit and scope of the disclosure.

BRIEF DESCRIPTION OF THE DRAWINGS

For a detailed description of the exemplary embodiments, reference will now be made to the accompanying drawings in which.

DETAILED DESCRIPTION OF THE PREFERRED EMBODIMENTS

Figure 1:
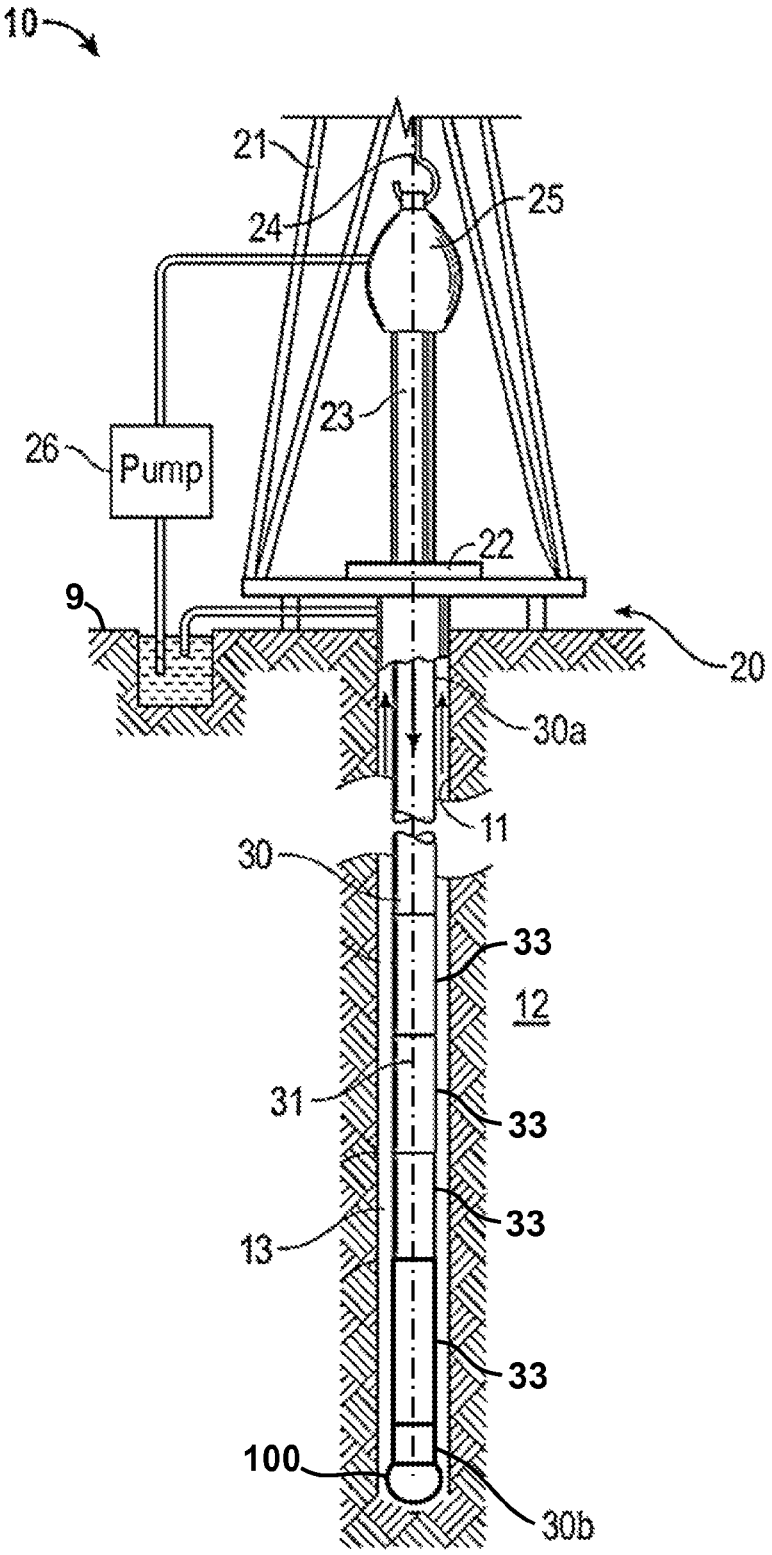
FIG. 1 is a schematic, partial side cross-sectional view of a drilling system including an embodiment of a drill bit in accordance with the principles disclosed herein.

The following discussion is directed to various embodiments. However, one skilled in the art will understand that the examples disclosed herein have broad application, and that the discussion of any embodiment is meant only to be illustrative of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and in the claims will be made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

A previously described, it is often necessary to change, replace, and/or repair the drill bit disposed at the lower end of the drill string once it has become damaged, worn out, or its cutting effectiveness has sufficiently decreased. For example, during drilling operations, drilling fluid, also referred to as "drilling mud," is pumped from the surface, through the drill string to the drill bit, and out nozzles in the face of the drill bit. The drilling fluid exits the bit and then flows back to the surface via the annulus between the borehole and/or casing and the drill string. In general, the drilling fluid functions to lubricate and cool the drill bit during drilling, as well as flush formation cuttings back to the surface through the annulus. As drilling fluid flows through the drill bit, particulate matter suspended in the drilling fluid may collect and buildup within one or more of the nozzles of the bit, thereby restricting the outflow of drilling fluids from such nozzles. In some cases, such nozzle restrictions may be sufficient to detrimentally affect drilling operations. In addition, such nozzle restrictions may result in an increase in the pressure within the drill bit as compared to the pressure within the downhole environment. Many downhole components (e.g., rotary steerable tools, under reamers, etc.) require a specific pressure drop across the bit (or range of suitable pressure drops) for their proper operation during drilling. Thus, the increase in pressure within the bit due to the flow restriction of created by the plugged or partially plugged nozzle can also detrimentally affect the performance of such downhole components. Further, different downhole components and/or operations require different pressure drops across the bit, and thus, in situations where multiple such components and/or operations are utilized, it is difficult to select an appropriate nozzle design.

Accordingly, embodiments disclosed herein include drill bits having one or more variable flow bores incorporated therein and configured to selectively allow drilling fluids to flow therethrough during drilling operations. In some embodiments, the one or more variable flow bores are configured to selectively allow drilling fluids to flow therethrough based on the differential pressure between the interior of the bit and the exterior environment (e.g., the borehole). In other embodiments, the one or more variable flow bores are configured to selectively allow drilling fluids to flow therethrough based on the flow rate of drilling fluids through the bit.

Referring now to FIG. 1, an embodiment of a drilling system 10 for drilling a borehole 11 in an earthen formation 12 is shown. In this embodiment, drilling system 10 includes a drilling rig 20 positioned over borehole 11 and a drill string 30 suspended from a derrick 21 of rig 20 into borehole 11.

Drill string 30 has a central or longitudinal axis 31, a first or uphole end 30*a* coupled to derrick 21, and a second or downhole end 30*b* opposite end 30*a*. A drill bit 100 is coupled to downhole end 30*b* of drill string 30. In this embodiment, drill string 30 is formed by a plurality of tubular pipe joints 33 connected end-to-end, and drill bit 100 is connected to the lower end of the lowermost pipe joint 33.

In this embodiment, drill bit 100 is rotated by rotation of drill string 30 from the surface 9. In particular, drill string 30 is rotated by a rotary table 22 that engages a kelly 23 coupled to uphole end 30*a* of drill string 30. Kelly 23, and hence drill string 30, is suspended from a hook 24 attached to a traveling block (not shown) with a rotary swivel 25 which permits rotation of drill string 30 relative to derrick 21. Although drill bit 100 is rotated from the surface with rotary table 22 and drill string 30, in general, the drill bit 100 can be rotated with a rotary table or a top drive disposed at the surface 9, a downhole mud motor disposed downhole, or combinations thereof (e.g., rotated by both rotary table via the drill string and the mud motor, rotated by a top drive and the mud motor, etc.). For example, rotation via a downhole motor may be employed to supplement the rotational power of a rotary table 22, if required, and/or to effect changes in the drilling process. Thus, it should be appreciated that the various aspects disclosed herein are adapted for employment in each of these drilling configurations and are not limited to conventional rotary drilling operations.

During drilling operations, a mud pump 26 at the surface 9 pumps drilling fluid or mud down the interior of drill string 30 via a port in swivel 25. The drilling fluid exits drill string 30 through ports or nozzles in the face of drill bit 100, and then circulates back to the surface 9 through the annulus 13 between drill string 30 and the sidewall of borehole 11. The drilling fluid functions to lubricate and cool drilling bit 100, and carry formation cuttings to the surface 14.

Figure 2:
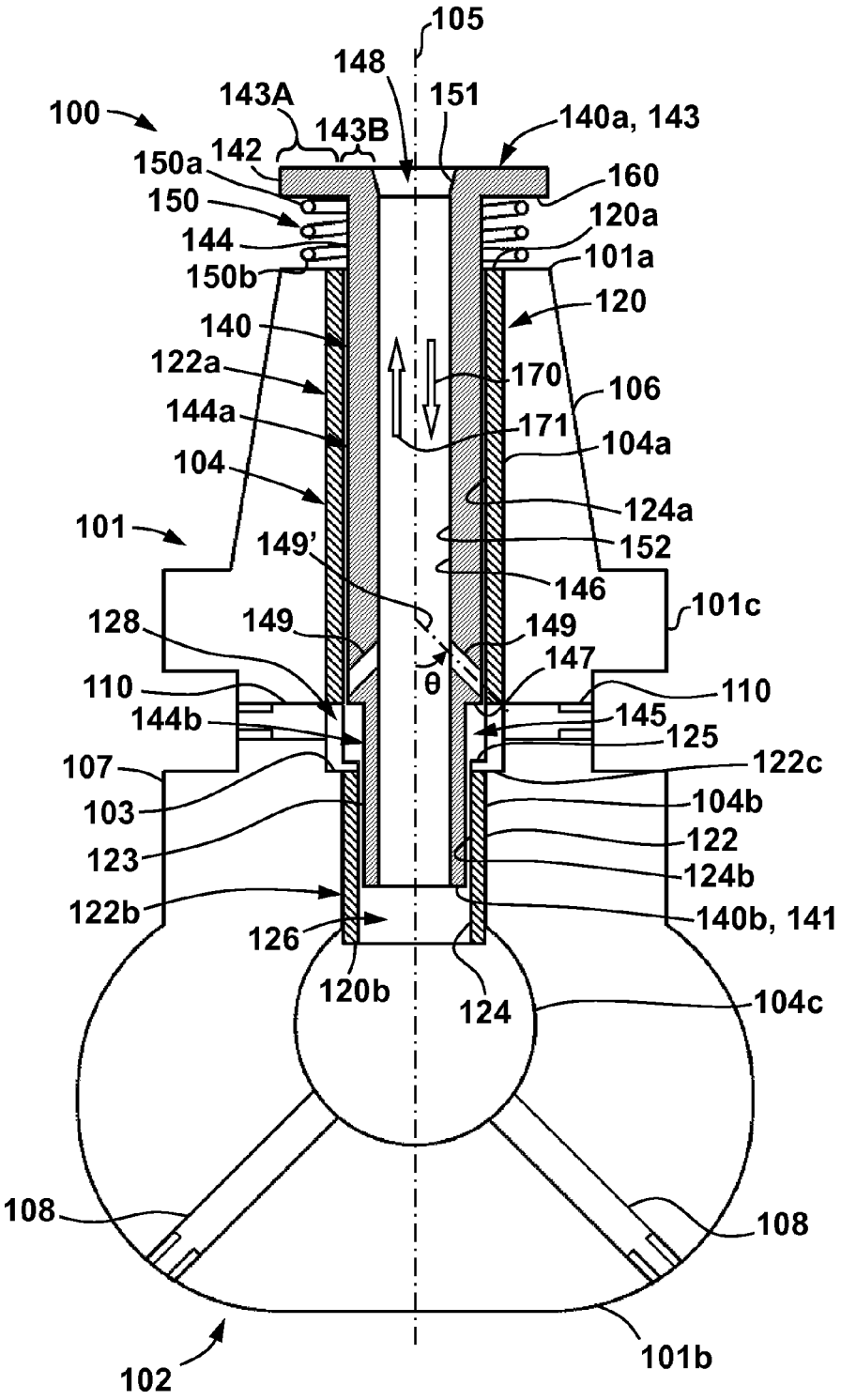
FIG. 2 is a schematic, side cross-sectional view of the drill bit of FIG. 1 with the actuating member disposed in a first position restricting the flow of drilling fluid through one or more of the variable flow bores.

Referring now to FIG. 2, drill bit 100 of drilling system 10 is shown. Bit 100 has a central or longitudinal axis 105 that may be aligned with axis 31 of drill string 30 and includes a bit body 101, an elongate sleeve or liner 120, and an actuating tube or member 140. Body 101, liner 120, and actuating member 140 are coaxially aligned such that each shares a common central axis 105.

Bit body 101 has a first or uphole end 101*a*, a second or downhole end 101*b* opposite uphole end 101*a*, and an outer surface 101*c* extending axially between ends 101*a*, 101*b*. In addition, bit body 101 includes an externally threaded male or pin connector 106 at uphole end 101*a* for coupling bit 100 to drill string 30, a cutting structure 102 at downhole end 101*b* for engaging and cutting the formation 12, and a central section 107 extending axially between pin connector 106 and cutting structure 102. In general, cutting structure 102 can be any suitable cutting structure for engaging and cutting a subterranean formation (e.g., formation 12) to form a borehole therethrough (e.g., borehole 11), such as, for example, a fixed cutter cutting structure, a rolling cone cutting structure, etc. In this embodiment cutting structure 102 is a fixed cutter cutting structure that is configured to shear off portions of borehole 11 when bit 100 is rotated about axis 105 in a cutting direction. In addition, bit body 101 includes an internal flow passage 104 extending axially from the uphole end 101*a*. In this embodiment, passage 104 includes a first or uphole cylindrical section 104*a* extending axially from end 101*a*, a lower chamber 104*c* proximal end 101*b*, a second or downhole cylindrical section 104*b* extending axially from chamber 104*c*, and an upward facing annular planar shoulder 103 extending radially between sections 104*a*, 104*b*. In this embodiment, chamber 104*c* is hemispherical in shape, however, in general, chamber 104*c* may be formed in any suitable shape for receiving a volume of drilling fluid therein.

A pair of primary flow bores 108 extend radially from chamber 104*c* through bit body 101 to the face of bit 100 disposed at downhole end 101*b*, thereby creating multiple flow paths between chamber 104*c* and the outer environment surrounding bit 100 (e.g., the borehole 11). Further, a pair of secondary variable flow nozzles or bores 110 extend radially from uphole cylindrical section 104*a* of passage 104 through central section 107 of body 101 to outer surface 101*c*, thereby creating multiple fluid flow paths from section 104*a* of passage 104 to the outer environment surrounding bit 100 (e.g., the borehole 11). As will be described in more detail below, during drilling operations, drilling fluid flows into bit 100 at uphole end 101*a* and exits bit 100 through one or more of the flow bores 108, 110.

Referring still to FIG. 2, elongate tubular sleeve 120 is fixably secured to bit body 101 within passage 104 and includes a first or uphole end 120*a* at end 101*a*, a second or downhole end 120*b* opposite uphole end 120*a*, a radially outer surface 122 extending axially between ends 120*a*, 120*b*, and a radially inner surface 124 extending axially between ends 120*a*, 120*b*. Inner surface 124 defines a through bore 126 extending axially through sleeve 120. Outer surface 122 includes a first or uphole cylindrical section 122*a* extending axially from uphole end 120*a*, a second or downhole cylindrical section 122*b* extending axially from downhole end 120*b*, and a downward facing annular planar shoulder 122*c* extending radially between sections 122*a*, 122*b*. Inner surface 124 includes a first or uphole cylindrical section 124*a* extending axially from uphole end 120*a*, a second or downhole cylindrical section 124*b* extending axially from downhole end 120*b*, and an upward facing annular planar shoulder 125 extending radially between sections 124*a*, 124*b*. A pair of circumferentially-spaced apertures or through holes 128 extend radially between the surfaces 122, 124 within uphole section 122*a*. As is shown in FIG. 2, when sleeve 120 is installed within passage 104, uphole section 122*a* of outer surface 122 engages bit body 101 along uphole section 104*a* of passage 104, downhole section 122*b* of outer surface 122 engages bit body 101 along downhole section 104*b* of passage 104, shoulder 122*c* abuts or engages shoulder 103, and apertures 128 are axially and circumferentially aligned with secondary flow bores 110. In general, sleeve 120 can be fixably secured to bit body 101 within passage 104 by any suitable method or means, such as, for example, by engaging corresponding threads on sleeve 120 and within passage 104.

In this embodiment, sleeve 120 is a wear component that slidably engages movable actuating member 140 (described below) to prevent excessive wear of bit body 101 during operations. Thus, in at least some embodiments, sleeve 120 comprises a relatively robust material such as, for example, Tungsten Carbide, that can better withstand prolonged sliding engagement with another component (e.g., actuating member 140), thereby increasing the effective usable life of bit 100.

Referring still to FIG. 2, actuating member 140 is an elongate tubular member slidingly disposed in sleeve 120. Actuating member 140 has a first or uphole end 140*a* axially positioned above end 101*a*, a second or downhole end 140*b* opposite uphole end 140*a*, a radially outer surface 144 extending axially between ends 140*a*, 140*b*, and a radially inner surface 146 extending axially between ends 140*a*, 140*b*. A flange 142 is disposed at uphole end 140*a* and has an upward facing annular planar surface 143 and a downward facing annular surface 160. Upward facing annular planar surface 143 includes a first annular portion 143A that is axially opposite surface 160 and has a surface area $SA_{143A}$ and a second annular portion 143B that is radially inward of first portion 143A and has a surface area $SA_{143B}$. Downhole end 140*b* has a downward facing annular planar surface 141 with a total surface area $SA_{141}$ Inner surface 146 defines a throughbore 148 that extends axially between ends 140*a*, 140*b* and is configured to receive drilling fluid pumped from the surface 9 during drilling operations. In this embodiment, inner surface 146 includes an upward facing frustoconical surface 151 disposed at uphole end 140*a* and a cylindrical surface 152 extending axially from surface 151 to downhole end 140*b*. Frustoconical surface 151 has a total surface area $SA_{151}$. Outer surface 144 includes a first or uphole cylindrical section 144*a* extending axially from end 140*a* and flange 142, a second or downhole cylindrical section 144*b* extending axially from downhole end 140*b*, and a downward facing annular planar shoulder 147 extending radially between sections 144*a*, 144*b*. Shoulder 147 has a total surface area $SA_{147}$. A pair of flow passages or ports 149 extend from inner surface 146 to outer surfaces 144. In this embodiment, each port 149 extends radially outward and axially downward along a central axis 149' moving from inner surface 146 to outer surface 144. Thus, central axis 149' is disposed at an acute angle θ with respect to central axis 105. In some embodiments, the angle θ is preferably between 0° and 90°, more preferably between 30° and 60°, and most preferably equal to 45°.

During assembly of bit 100, actuating member 140 is installed within throughbore 126 of sleeve 120 with uphole section 144*a* of outer surface 144 slidingly engaging uphole section 124*a* of inner surface 124, and downhole section 144*b* of outer surface 144 slidingly engaging downhole section 124*b* of inner surface 124. In addition, annular shoulders 125, 147 are axially opposed and face each other. However, shoulders 125, 147 are axially spaced apart, thereby forming an annulus or annular chamber 145 therebetween. As will be described in more detail below, chamber 145 is in constant fluid communication with the outer environment surrounding bit 100 (e.g., borehole 11) through apertures 128 and flow bores 110 such that the pressure within chamber 145 is the same or substantially the same as that outside of bit 100.

Referring still to FIG. 2, an axial biasing member 150 is disposed between flange 142 and uphole end 101*a* of bit body 101. In particular, biasing member 150 has a first or uphole end 150*a* engaging flange 142 and a downhole end 150*b* engaging end 101*a* of bit body 101. Biasing member 150 is compressed between flange 142 and end 101*a*, thereby biasing flange 142 and end 101*a* axially apart. In this embodiment, biasing member 150 is a coil spring disposed about actuating member 140.

Figure 3:
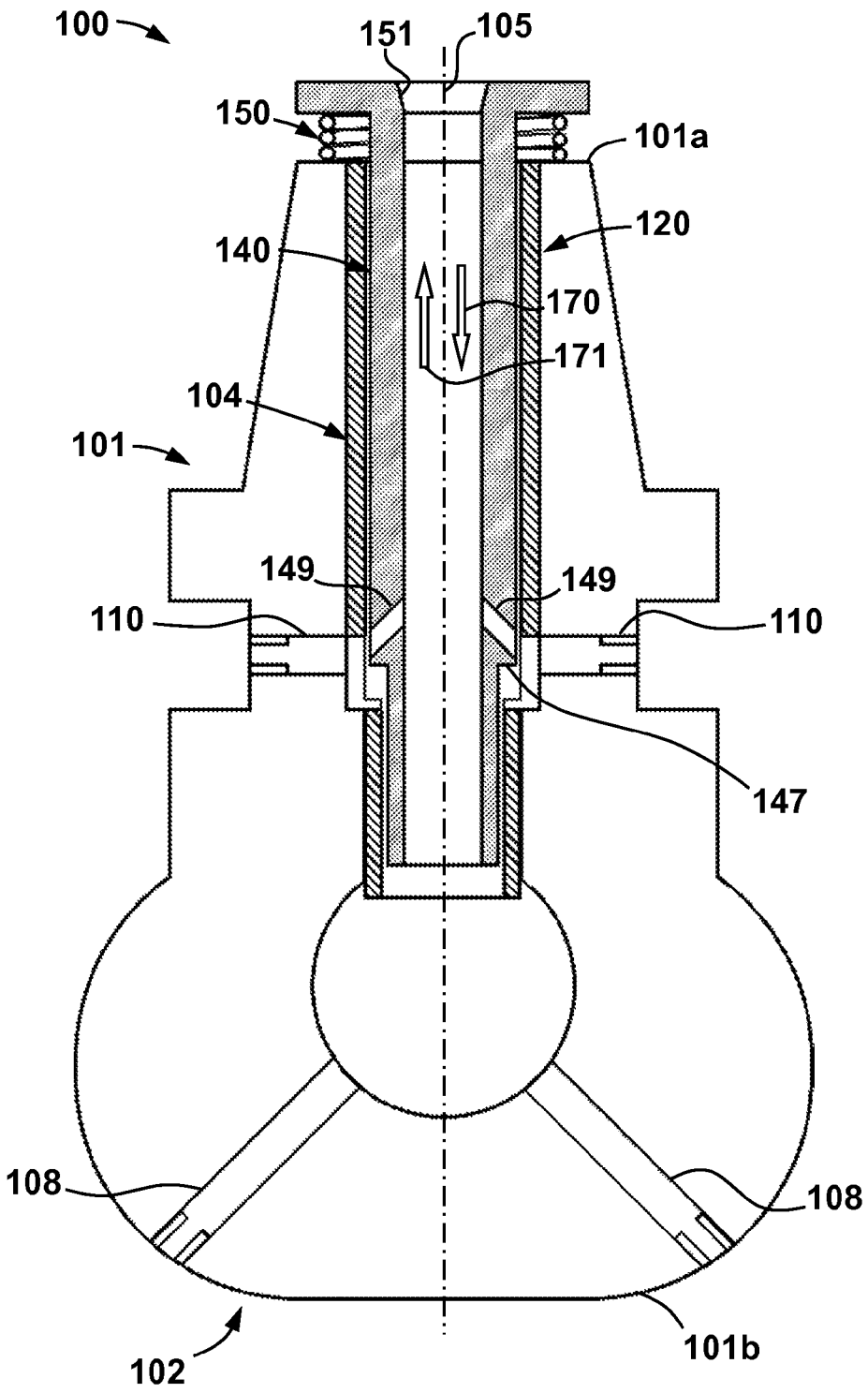
FIG. 3 is a schematic, side cross-sectional view of the drill bit of FIG. 1 with the actuating member disposed in a second position allowing drilling fluid to flow through one or more of the variable flow passages.

Referring now to FIGS. 1-3, during drilling operations bit 100 is coupled to downhole end 30*b* and bit 100 is rotated about the axes 31, 105 with weight-on-bit (WOB) applied such that cutting structure 102 engages formation 12 to lengthen borehole 11. While rotating bit 100, drilling fluid (e.g., drilling mud) is pumped from the surface 9 down drill string 30 to bit 100. In addition, during these operations, actuating member 140 can be transitioned between a first or closed position with flow ports 149 axially misaligned with apertures 128 and flow bores 110 as shown in FIG. 2, and a second or open position with flow ports 149 at least partially axially aligned with apertures 128 and flow bores 110 as shown in FIG. 3. Thus, when member 140 is in the first position (FIG. 2) fluid communication between throughbore 148 and bores 110 is restricted such that drilling fluids flow through throughbore 148 of actuating member 140 into chamber 104*c* and through flow bores 108, but are restricted from flowing through flow bores 110. Conversely, when member 140 is in the second position (FIG. 3), fluid communication between throughbore 148 and bores 110 is established such that a portion of drilling fluids flows through ports 149 and flow bores 110, while the remainder of the drilling fluids flow through throughbore 148 of actuating member 140 into chamber 104*c* and through flow bores 108. Translation of member 140 from the first position (FIG. 2) to the second position (FIG. 3) occurs along a first axial direction 170 and translation of member 140 from the second position to the first position occurs along a second axial direction 171 that is opposite the first axial direction 170. In this embodiment, axial translation of member 140 in the first direction 170 may continue until annular shoulder 147 on member 140 axially abuts and engages annular shoulder 125 on sleeve 120. In some embodiments, axial translation of member 140 in the second direction 171 is limited by a suitable device (not shown) such as, for example, a retaining pin, a snap ring, a biasing member (e.g., a spring), etc. In other embodiments, axial translation of the member 140 in the second direction 171 is limited by engagement with the box connector of the immediately axially adjacent member to bit 100 within the drill string (e.g., drill string 30).

In this embodiment, actuating member 140 transitions between the first position and the second position in response to a sufficient pressure differential across transition member 140. In particular, the surface areas $SA_{143B}$, $SA_{141}$, $SA_{147}$, $SA_{151}$ of surfaces 143B, 141, 147, 151, respectively, are each arranged and sized, and the biasing force supplied by member 150 is chosen, such that actuating member 140 translates in the first direction 170 when the pressure drop between throughbore 148 (and this section 104*a* of passage 104) and the outer environment of the bit 100 (e.g., borehole 11) reaches a predetermined level. In this embodiment, when the bit internal pressure $P_1$ is sufficiently greater than the bit external pressure $P_2$, the internal pressure $P_1$ applied to surfaces 143, 151 will be sufficient to overcome the combined forces of: (1) the bit internal pressure $P_1$ applied to the surface 141, (2) the biasing force supplied by biasing member 150, and (3) the wellbore pressure, $P_2$, operating on shoulder 147 through chamber 145, such that actuating member 140 translates in the first direction 170 toward downhole end 101*b*. As a result, during drilling operations, if the drop in pressure for the drilling fluids flowing from bit 100 into borehole 11 should increase above the predetermined level (e.g., if the pressure of fluid supplied by pump 26 is increased, if one or more of the flow bores 108 should become restricted, if the pressure within borehole 11 should decrease, etc.), then member 140 translates in the first direction 170 toward lower end 101*b* to allow drilling fluid to flow through flow bores 110, thereby at least partially relieving the pressure difference between throughbore 148 and borehole 11. As the pressure difference between throughbore 148 and borehole 11 falls to within an acceptable range, member 140 translates axially in the second direction 171 toward uphole end 101*a*, such that flow ports 149 are once again misaligned with apertures 128 and flow bores 110 and the flow of drilling fluids through ports 149, apertures 128, and bores 110 is once again restricted. Thus, the translation of actuating member 140 within passage 104 of body 101 allows the pressure drop across bit 100 to be maintained at a predetermined value or range of values during drilling operations. In some embodiments, the previously determined pressure difference between throughbore 148 and borehole 11 that is sufficient to transition member 140 in first direction 170 toward the second position preferably ranges from 100 psi to 1000 psi, and more preferably ranges from 200 psi to 800 psi.

In the embodiment of drill bit 100 previously described, actuating member 140 transitions between the first position and the second position, thereby opening and closing flow bores 110 in response to a pressure difference between throughbore 148 and borehole 11. However, in other embodiments, in accordance with the principles disclosed herein, variable flow bores are opened and closed based on the flow rate of drilling fluid flowing therethrough. For example, referring now to FIG. 4, an embodiment of a drill bit 200 for use in drilling system 10 is shown. Bit 200 has a central or longitudinal axis 205 that may be aligned with axis 31 of drill string 30 during operations. In addition, in this embodiment, includes a bit body 201, an elongate sleeve or liner 220 disposed in bit body 201, and an actuating tube or member 240 moveably disposed in sleeve 220. Body 201, sleeve 220, and member 240 are coaxially aligned such that each shares a common central axis 205.

Bit body 201 is substantially the same as bit body 101 previously described. In particular, bit body 201 has a first or uphole end 201*a*, a second or downhole end 201*b* opposite uphole end 201*a*, an outer surface 201*c* extending axially between ends 201*a*, 201*b*. In addition, bit body 201 includes pin connector 106 at uphole end 201*a*, cutting structure 102 at downhole end 201*b*, a central section 207 extending axially between connector 106 and structure 102, an internal passage 204 extending axially from end 201*a*, and a pair of fluid flow bores 210 extending radially from passage 204 through central section 207 of body 201 to outer surface 201*c*. Passage 204 includes a first or uphole cylindrical section 204*a* and a chamber 204*b*. Section 204*a* extends axially from end 201*a* to chamber 204*b*. Thus, unlike passage 104 of bit 100 previously described, in this embodiment, passage 204 only includes one cylindrical section 204*a* extending between end 201*a* and chamber 204*b*. Further, bit body 201 also includes flow bores 208 extending from chamber 204*b* to the face of bit 200 at end 201*b* in a similar manner to that described above for bores 108 on bit 100, previously described.

Figure 4:
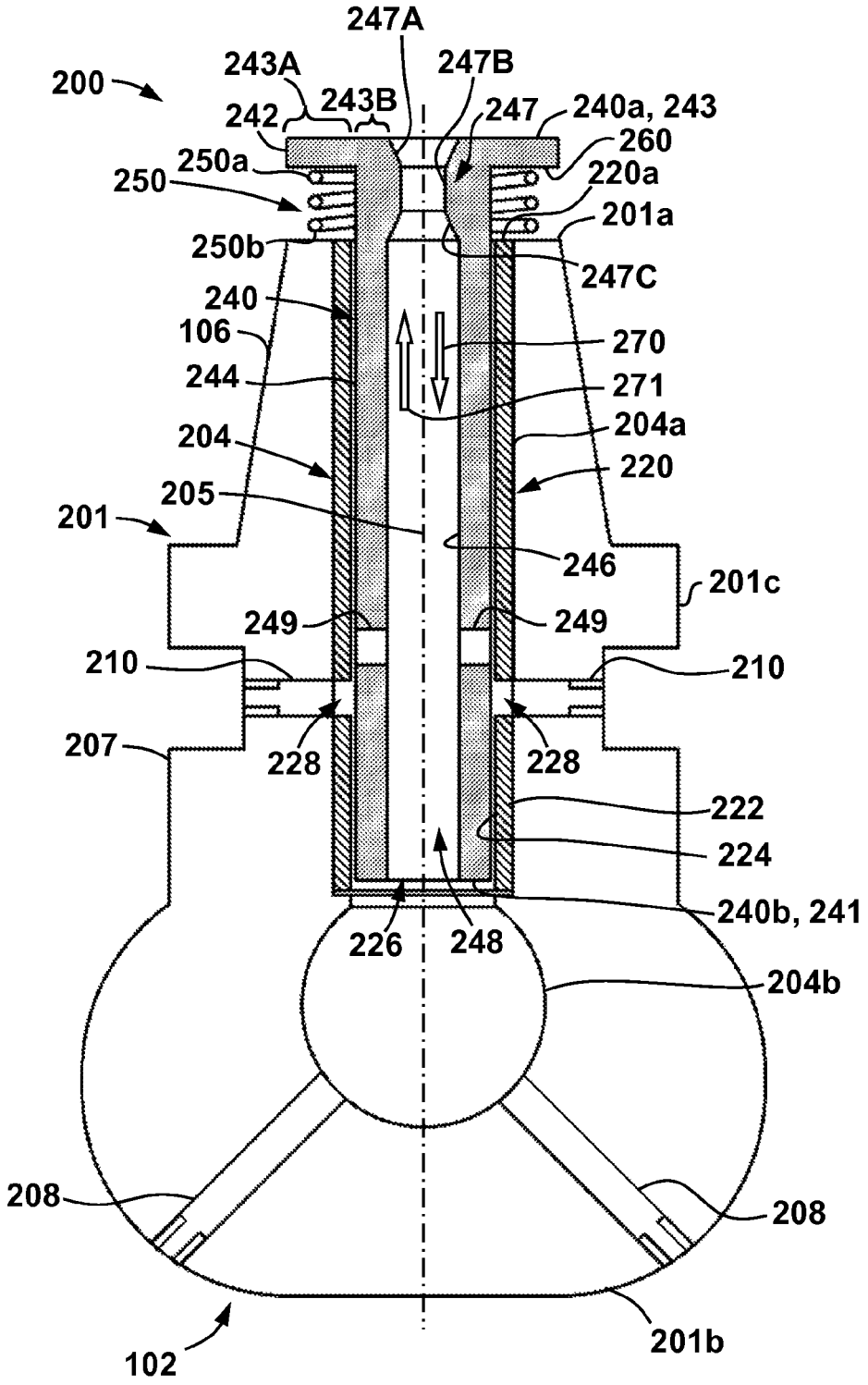
FIG. 4 is a schematic, side cross-sectional view of an embodiment of a drill bit for use with the drilling system of FIG. 1 with an actuating member disposed in a first position restricting the flow of drilling fluid through one or more variable flow passages.

Referring still to FIG. 4, elongate tubular sleeve 220 is fixably disposed in passage 204 and includes a first or uphole end 220*a*, a second or downhole end 220*b* opposite uphole end 220*a*, a radially outer surface 222 extending axially between ends 220*a*, 220*b*, and a radially inner surface 224 extending axially between ends 220*a*, 220*b*. Inner surface 224 defines a throughbore 226 extending axially through sleeve 220. Each surface 222, 224 is cylindrical, and thus, the radius of each surface 222, 224 does not vary between ends 220*a*, 220*b*. A pair of circumferentially-spaced apertures or through holes 228 extend radially from inner surface 224 to outer surface 222. When sleeve 220 is installed within passage 204, apertures 228 are axially and circumferentially aligned with flow bores 210.

Similar to sleeve 120 previously described, sleeve 220 is a wear component that engages with the movable actuating member 240 (described below). Thus, in at least some embodiments, sleeve 220 comprises a relatively robust material such as, for example, Tungsten Carbide, that can better withstand prolonged sliding engagement with another component (e.g., actuating member 240), thereby increasing the effective usable life of bit 200.

Referring still to FIG. 4, actuating member 240 is an elongate tubular member slidingly disposed in sleeve 220. Actuating member 240 has a first or uphole end 240*a*, a second or downhole end 240*b* opposite uphole end 240*a*, a radially outer surface 244 extending axially between ends 240*a*, 240*b*, and a radially inner surface 246 extending axially between ends 240*a*, 240*b*. An annular flange 242 is disposed at uphole end 240*a*. Flange 242 has an upward facing annular planar surface 243 and a downward facing annular surface 260. Upward facing annular planar surface 243 includes a first annular portion 243A that is axially opposite surface 260 and has a surface area $SA_{243A}$ and a second annular portion 243B that is radially inward of first portion 243A and has a surface area $SA_{243B}$. Downhole end 240*b* has a downward facing annular planar surface 241 with a total surface area $SA_{241}$. Inner surface 246 defines a throughbore 248 that extends axially between ends 240*a*, 240*b* and is configured to receive drilling fluid pumped from the surface 9 during drilling operations. Unlike sleeve 140 of bit 100 previously described, in this embodiment, throughbore 248 of sleeve 240 includes a flow restrictor 247 at uphole end 240*a*. As drilling fluid flows through restrictor 247, its fluid pressure is reduced. In this embodiment, restrictor 247 is a converging-diverging nozzle including a first or uphole upward facing frustoconical surface 247A, a second or downhole downward facing frustoconical surface 247C, and a cylindrical surface 247B extending axially between surfaces 247A, 247C. Each of the frustoconical surface 247A, 247C has a total surface area $SA_{247A}$, $SA_{247C}$, respectively. In this embodiment, surfaces areas $SA_{247A}$, $SA_{247C}$ are the same.

Outer surface 244 is cylindrical between flange 242 and end 240*b*, and thus, is disposed at a uniform radius between flange 242 and end 240*b* Inner surface 246 is cylindrical between restrictor 247 and end 240*b*, and thus, is disposed at a uniform radius between restrictor 247 and end 240*b*. Thus, unlike bit 100 previously described, which includes chamber 145 (FIG. 2), in this embodiment, no chamber(s) are provided between passage 204, sleeve 220, and actuating member 240.

Referring still to FIG. 4, a pair of flow passages or ports 249 extend radially through member 240 from inner surface 246 to outer surface 244. In addition, a biasing member 250 is axially positioned between flange 242 and uphole end 201*a*. More specifically, biasing member 250 has a first or uphole end 250*a* engaging flange 242 and a downhole end 250*b* engaging uphole end 201*a*. Biasing member 250 is compressed between flange 242 and end 201*a*, and thus, biases flange 242 and bit body 201 axially apart. In this embodiment, biasing member 250 is a coil spring disposed about actuating member 240.

Figure 5:
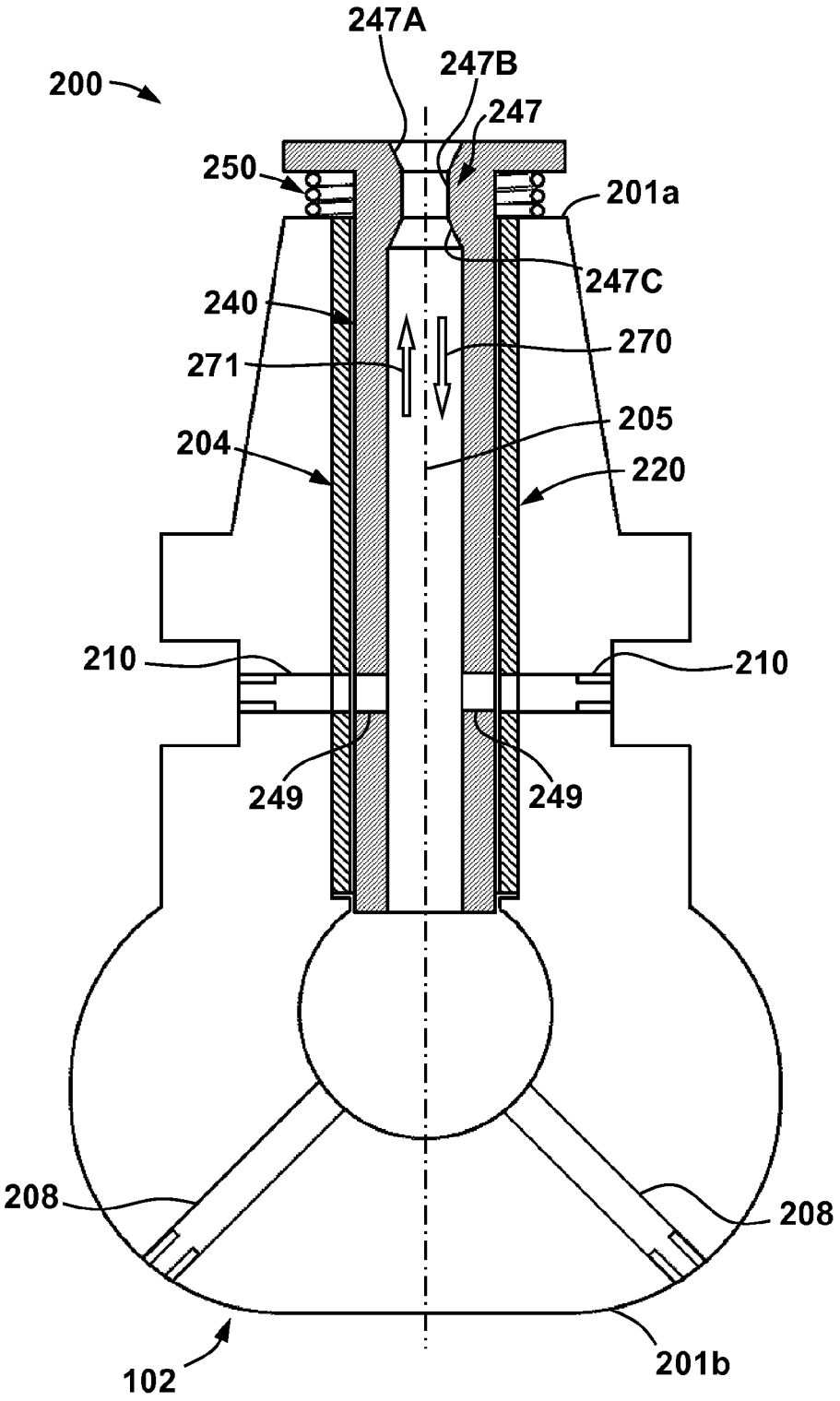
FIG. 5 is a schematic, side cross-sectional view of the drill bit of FIG. 4, with the actuating member disposed in a second position allowing drilling fluid to flow through one or more of the variable flow passages.

Referring now to FIGS. 1, 4, and 5, during drilling operations bit 200 is coupled to downhole end 30*b* of drill string 30 and bit 200 is rotated about the aligned axes 31, 205 with weight-on-bit (WOB) is applied such that cutting structure 102 engages with formation 12 to lengthen borehole 11 along a predetermined path. While rotating bit 200, drilling fluid (e.g., drilling mud) is pumped from the surface 9 down drill string 30 to bit 200. In addition, during these operations actuating member 240 can be transitioned between a first or closed position with flow ports 249 are axially misaligned with apertures 228 and flow bores 210 as shown in FIG. 4, and a second or open position with flow ports 249 at least partially axially aligned with apertures 228 and flow bores 210 as shown in FIG. 5. Thus, when member 240 is in the first position (FIG. 4) fluid communication between throughbore 248 and bores 210 is restricted such that drilling fluids flow through throughbore 248 to flow bores 208, but are restricted from flowing through flow bores 210. Conversely, when member 240 is in the second position (FIG. 5), fluid communication between throughbore 248 and bores 210 is established such that a portion of drilling fluids flow through ports 249 and flow bores 210, while the remainder of the drilling fluids flow through passage 248 of actuating member 240 into chamber 204*b* and through flow bores 208. Translation of member 240 from the first position (FIG. 4) to the second position (FIG. 5) occurs along a first axial direction 270 and translation of member 240 from the second position to the first position occurs along a second axial direction 271 that is opposite the first axial direction 270. In this embodiment, axial translation of member 240 in first direction 270 may continue until biasing member 150 is fully compressed between flange 242 and uphole end 201*a* of body 201.

In this embodiment, actuating member 240 transitions between the first position and the second position in response to the flow rate of drilling fluids flowing through bit 200. In particular, as drilling fluid flows through throughbore 248 within bit 200, there is a local pressure drop for drilling fluids across nozzle 247 (i.e., the pressure of the drilling fluid upstream of nozzle 247 is greater than the pressure of drilling fluid downstream of nozzle 247). As a result, member 240 is actuated in the first direction 270 when the pressure $P_3$ of the drilling fluids upstream of nozzle 247 acting on surfaces 243B, 247A is larger than the combination of the pressure $P_4$ of the drilling fluids downstream of nozzle 247 acting on surfaces 247C, 241 and the biasing force supplied by biasing member 250. Thus, actuation of member 240 is not necessarily dependent on the relative difference in pressure between throughbore 248 and borehole 11 as is the case for bit 100 previously described. Rather, in bit 200, actuation of member 240 is dependent upon the pressure drop across nozzle 247. Without being limited by this or any particular theory, the pressure drop across a converging-diverging nozzle (e.g., nozzle 247) is directly related to the flow rate through the nozzle, and thus, as the flow rate through a converging diverging nozzle increases, the pressure drop across the nozzle increases. In this embodiment, actuation member 240 is configured to transition from the first position to the second position at a predetermined flow rate (or within a predetermined range of flow rates) and associated pressure drop (or within a range of pressure drops) across nozzle 247 (e.g., the difference between $P_3$ and $P_4$). More specifically, in this embodiment, the surface areas $SA_{243B}$, $SA_{247A}$, $SA_{247C}$, $SA_{241}$ of surfaces 243B, 247A, 247C, 241, respectively, are arranged and sized, and the biasing force supplied by member 250 is chosen, such that when the flow rate of drilling fluid through nozzle 247 is at or above a predetermined value, the pressure drop across nozzle 247 is sufficient to transition member 240 in the first direction 270 from the first position (FIG. 4) to the second position (FIG. 5). For example, in one embodiment, actuating member 240 is configured such that a flow rate of drilling fluids between 400 and 500 GPM (gallons per minute) will not produce a sufficient pressure drop across nozzle 247 to enable member 240 to transition in the first direction 270, however, once the flow of drilling fluids exceeds 550 GPM, the pressure drop across nozzle 247 is sufficient to axial translate member 240 to the second position (i.e., move member 240 in the first direction 270).

Actuation of member 240 within drill bit 200 to allow flow of drilling fluids through the flow bores 210 is particularly useful when an increased flow of drilling fluid through bit 200 is desired. For example, during drilling operations, it sometimes becomes desirable to flow an increased volume of drilling fluid through the drill string (e.g., drill string 30), bit (e.g., bit 200), and annulus (e.g., annulus 13) to sweep or clean cuttings or other materials from the wellbore (e.g., borehole 11). Thus, by allowing additional flow to escape bit 200 through flow bores 210 upon increasing the flow rate of drilling fluids flowing therethrough, the bit 200 is able to better accommodate such operations.

In the embodiments previously described, bits 100, 200 are fixed cutter bits including cutting structures defined by a plurality of blades and cutter elements secured thereto. However, in other embodiments, variable flow bores configured to transition between opened and closed positions in response to pressure differentials or drilling fluid flow rates can be used with other types of drill bits and downhole tools. For example, referring now to FIG. 6, an embodiment of a rolling cone drill bit 300 for use in drilling system 10 is shown. Bit 300 has a central or longitudinal axis 305 that may be aligned with axis 31 of drill string 30 during operations. In addition, in this embodiment, bit 300 includes a bit body 301 and an actuating tube or member 340 moveably disposed in body 301. Body 301 and member 340 are coaxially aligned such that each shares a common central axis 305.

Figure 6:
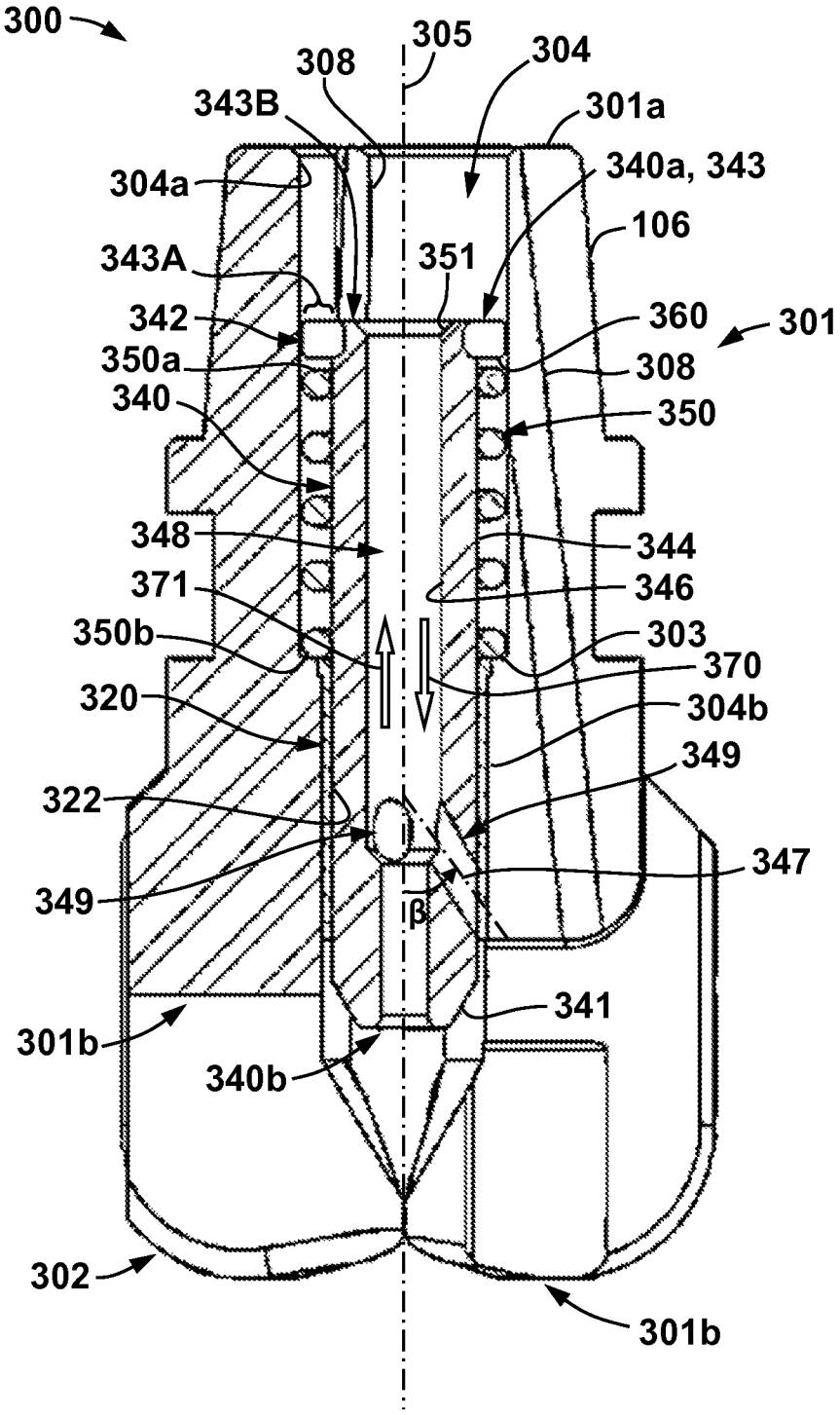
FIG. 6 is a schematic, partial side cross-sectional view of an embodiment of a drill bit for use with the drilling system of FIG. 1 with an actuating member disposed in a first position restricting the flow of drilling fluid through one or more variable flow passages.
Figure 7:
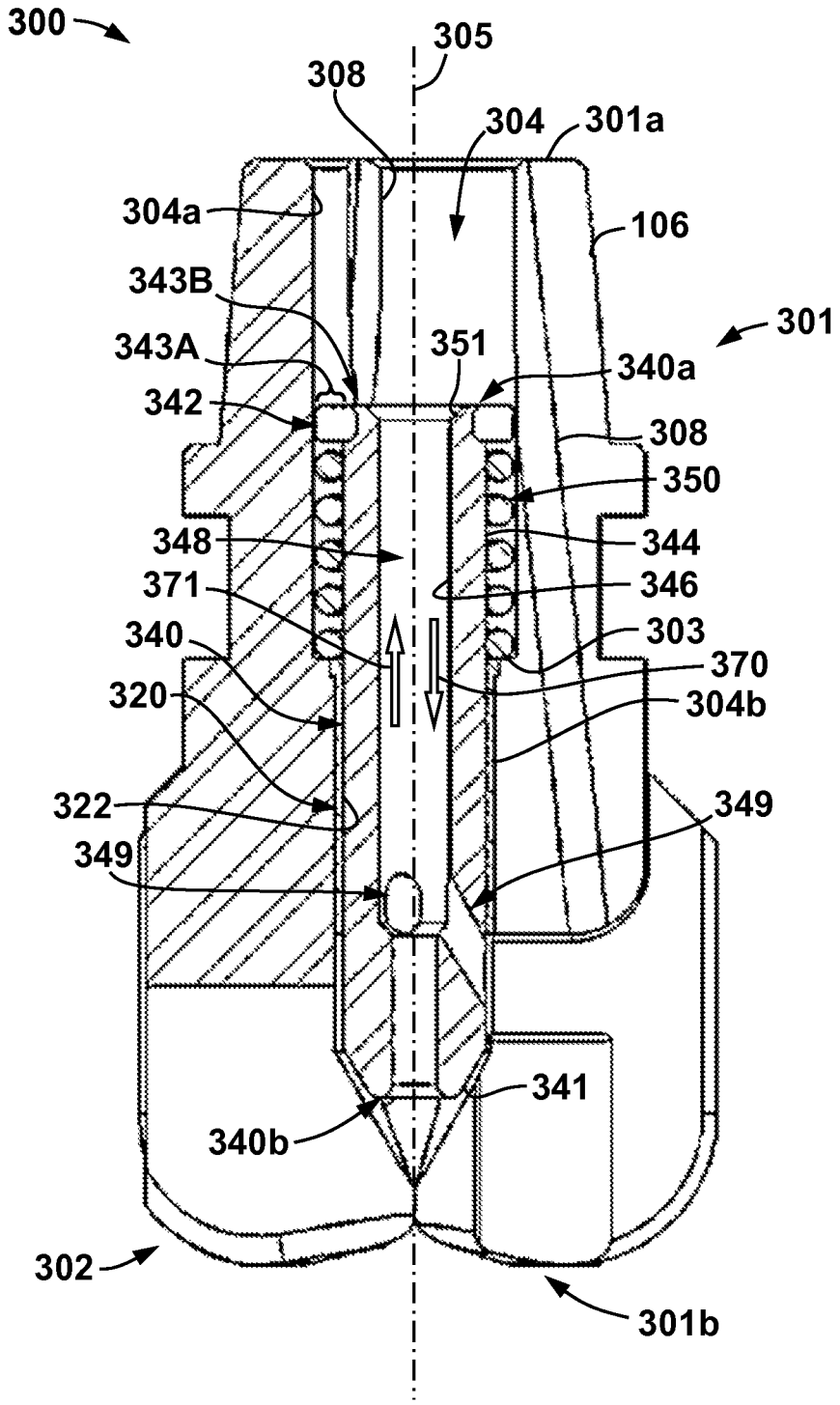
FIG. 7 is a schematic, partial side cross-section view of the drill bit of FIG. 6 with the actuating member disposed in a second position allowing drilling fluid to flow through one or more of the variable flow passages.

Bit body 301 has a first or uphole end 301*a*, a second or downhole end 301*b* opposite uphole end 301*a*, an externally threaded male or pin connector 106 at upper end 301*a*, and a cutting structure 302 at downhole end 301*b* for engaging and cutting the formation 12. In this embodiment, cutting structure 302 comprises a plurality of rolling cones rotatably mounted to journals depending from bit body 301 and a plurality of cutting elements secured to each rolling cone to gouge or puncture formation 12. In addition, bit body 301 includes an internal flow passage 304 extending axially from the uphole end 301*a*. In this embodiment, passage 304 has a first or uphole cylindrical section 304*a* extending axially from uphole end 301*a* to an annular upward facing planar shoulder 303 and a second or downhole cylindrical section 304*b* extending axially from shoulder 303. A plurality of circumferentially-spaced primary nozzles or flow bores 308 extend from uphole section 304*a* of passage 304 to a face of bowl of bit body 301 at end 301*b*, thereby creating a flow path between passage 304 and the outer environment surrounding bit 300 (e.g., the borehole 11) (note: only two flow bores 308 are shown in FIGS. 6 and 7). An annular sleeve member 320 is fixably disposed in passage 304 along downhole section 304*b*. Sleeve member 320 has a radially inner cylindrical surface 322. As will be described in more detail below, inner surface 322 of sleeve 320 is configured to slidingly engage with a corresponding outer surface of actuating member 340 during operations to protect bit body 301 from excessive wear. Accordingly, sleeve member 320 is preferably made of the same materials previously described above for sleeves 120, 220.

Referring still to FIG. 6, actuating member 340 is an elongate tubular member having a first or uphole end 340*a*, a second or downhole end 340*b* opposite uphole end 340*a*, a radially outer surface 344 extending axially between ends 340*a*, 340*b*, and a radially inner surface 346 extending axially between ends 340*a*, 340*b*. A retaining ring or flange 342 is disposed at uphole end 340*a*. Flange 342 includes an upward facing annular planar surface 343 and a downward facing annular surface 360. Upward facing annular planar surface 343 includes a first annular portion 343A that is axially opposite surface 360 and has a surface area $SA_{343A}$ and a second annular portion 343B that is radially inward of first portion 343A and has a surface area $SA_{343B}$. In addition, downhole end 340*b* of member 340 includes a downward facing frustoconical surface 341 having a total surface area $SA_{341}$. Inner surface 346 defines a throughbore 348 extending axially through member 340 between ends 340*a*, 340*b* and is configured to receive drilling fluid pumped from the surface during drilling operations. In this embodiment, inner surface 346 includes an upward facing frustoconical surface 351 axially positioned at uphole end 340*a* and having a total surface area $SA_{351}$. A plurality of radial flow passages or bores 349 extend radially through member 340 between the surfaces 344, 346 along an axis of flow 347 that is disposed at an acute angle β with respect to central axis 305 (note: only two flow passages 349 are shown in FIGS. 6 and 7). In this embodiment, angle β is preferably the same as angle θ previously described above for bit 100 (and thus the potential range of values for angle β is the same as that previously described above for angle θ).

During assembly of bit 300, actuating member 340 is installed within flow passage 304 of bit 300 such that uphole section outer surface 344 slidingly engages radially inner surface 322 of sleeve 320 and flange 342 axially opposes shoulder 303. A biasing member 350, which is similar to biasing member 150 previously described, is axially positioned between flange 342 and shoulder 303. In particular, biasing member 350 has a first or uphole end 350*a* that axially abuts and engages flange 342 and a second or downhole end 350*b* that axially abuts and engages shoulder 303. Biasing member 350 is axially compressed between flange 342 and shoulder 303, and thus, biases actuating member 340 axially away from downhole end 301*b* and toward uphole end 301*a* of bit 300. In this embodiment, biasing member 350 is a coiled spring disposed about actuating member 340.

Referring now to FIGS. 1, 6, and 7, during drilling operations, bit 300 is coupled to downhole end 30*b* of drill string 30 and bit 300 is rotated about the axes 31, 305 with weight-on-bit (WOB) is applied such that the cutting structure of bit 302 engages with formation 12 to lengthen borehole 11. While rotating bit 300, drilling fluid (e.g., drilling mud) is pumped from the surface 9 down drill string 30 to bit 300. In addition, during these operations actuating member 340 can be transitioned between a first or closed position with flow bores 349 axially disposed within downhole section 304*b* of passage 304 as shown in FIG. 6, and a second or open position with flow bores 349 extending at least partially axially past downhole end 301*b* and out from passage 304 as shown in FIG. 7. Thus, when member 340 is in the first position (FIG. 6) fluid communication between throughbore 348 and borehole 11 through bores 349 is restricted such that drilling fluids flow through passage 304 and bores 308, and are restricted from flowing through bores 349. Conversely, when member 340 is in the second position (FIG. 7), fluid communication between throughbore 348 and borehole 11 bores 349 is established such that a portion of drilling fluids flow through passage 304 and bores 308, while the remainder of the drilling fluids flow through both throughbore 348 of actuating member 340 and bores 349. Translation of member 340 from the first position (FIG. 6) to the second position (FIG. 7) occurs along a first axial direction 370 and translation of member 340 from the second position to the first position occurs along a second axial direction 371 that is opposite the first axial direction 370. As member 340 translates in axial directions 370, 371, outer surface 344 of member 340 slidingly engages inner surface 322 of sleeve 320 within downhole section 304*b* of passage 304. In this embodiment, axial translation of member 340 in the first direction 370 may continue until biasing member 350 is fully compressed between flange 342 and shoulder 303.

Similar to bit 100 previously described, bit 300 is arranged to actuate member 340 based on the pressure differential between internal flow passage 304 and the external environment surrounding bit 300 (e.g., borehole 11). In particular, in this embodiment the surface areas $SA_{343B}$, $SA_{341}$, $SA_{351}$ of surfaces 343, 341, 351, respectively, on member 340 are arranged and sized, and the biasing force supplied by biasing member 350 is chosen, such that such that actuating member 340 translates in the first direction 370 when the pressure drop between through passage 304 (particularly uphole section 304*a*) and the outer environment of the bit 300 (e.g., borehole 11) reaches a predetermined level. It should be appreciated that for the arrangement shown, downhole end 340*b* of actuating member 340 is exposed to the pressure within borehole 11 through downhole section 304*b* of passage 304. Therefore, during drilling operations, if the drop in pressure for the drilling fluids flowing from bit 300 into borehole 11 should increase above the previously determined level (e.g., if the pressure of fluid supplied by pump 26 is increased, if one or more of the bores 308 should become restricted, if the pressure within borehole 11 should decrease, etc.), then member 340 translates in the first direction 370 toward lower end 301*b* to allow an additional flow of drilling fluid through the radial flow bores 349 such that the pressure difference between passage 304 and borehole 11 falls back to an acceptable level or within an acceptable range. As the pressure difference between passage 304 and borehole 11 falls to within an acceptable range, member 340 translates axially in the second direction 371 toward uphole end 301*a*, such that flow bores 349 are once again axially disposed within downhole section 304*b* of passage 304 (such as is shown in FIG. 6) and are thus restricted. Therefore, the translation of actuating member 340 within passage 304 of body 301 allows the pressure drop across bit 300 to be maintained at a desired value or range of values during drilling operations.

In the manner described, the flow of drilling fluid may be selectively diverted through one or more variable flow nozzles (e.g., flow bores 110) disposed in a drill bit (e.g., bit 100, 200, 300) during drilling operations based either on the differential pressure between the interior and exterior of the drill bit and/or the flow rate of drill fluids flowing through the drill bit. Through use of embodiments of drill bits in accordance with the principles disclosed herein (e.g., bit 100, 300), undesirable pressure increases within the interior of the bit are automatically accounted for by the additional outflow of excess fluid through the variable flow nozzles (e.g., flow bores 110). In addition, in at least some embodiments, use of a drill bit in accordance with the principles disclosed herein (e.g., bit 200) helps to automatically accommodate increased flow of drilling fluids therethrough (e.g., such as during a clean out operation of the wellbore) thereby further enhancing downhole operations.

It should be appreciated that the above described embodiments may include further modification while still complying with the principles disclosed herein. For example, in some embodiments, one or more shear pins may be engaged between the central flow passage of the bit (e.g., passage 104, 204, 304) and/or the sleeve (e.g., sleeves 120, 220, 320) and the actuating member (e.g., members 140, 240, 340) to resist undesired axial movement of the actuating member. During operations of such embodiment, the initial movement of the actuating member would be initiated by exerting a predetermined pressure on the actuating member (e.g., via a flow of drilling fluid) to shear off each of the one or more shear pins and thereby allow axial movement of the actuating member thereafter as previously described above. In addition, some embodiments may include annular seal assemblies radially disposed between the actuating member (e.g., members 140, 240, 340) and the sleeve (e.g., sleeves 120, 220, 320) to further restrict fluid flow between these components during drilling operations. Further, it should be appreciated that the number and arrangement of flow bores or passages (e.g., bores 108, 208, 308, 110, 210 and/or ports 149, 249, 349) can be greatly varied from that shown and described herein while still complying with the principles disclosed herein.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A drill bit for drilling a borehole in a subterranean formation, the drill bit comprising:

a bit body having a central axis, a first end, a second end opposite the first end, and a radially outer surface, wherein the bit body includes a flow passage extending axially from the first end, and a cutting structure disposed at the second end;

an actuating member disposed within the flow passage, wherein the actuating member includes a throughbore, a radially outer surface, and a fluid flow port extending radially from the throughbore to the radially outer surface of the actuating member;

a sleeve fixably disposed within the flow passage, wherein the sleeve is radially positioned between the actuating member and the bit body;

wherein the actuating member is configured to move axially relative to the bit body between a first position restricting fluid communication between the throughbore and the borehole through the fluid flow port and a second position allowing fluid communication between the throughbore and the borehole through the fluid flow port;

wherein the bit body further includes a first flow bore extending from the flow passage to the radial outer surface;

wherein fluid communication between the throughbore and the first flow bore is restricted with the actuating member is in the first position, and wherein fluid communication between the throughbore and the first flow bore is allowed with the actuating member is in the second position;

wherein in the first position the fluid flow port of the actuating member is out of axial alignment with the first flow bore; and wherein in the second position the fluid flow port of the actuating member is at least partially axially aligned with a first nozzle.

2. The drill bit of claim 1, wherein the actuating member is axially biased to the first position.

3. The drill bit of claim 1, wherein the actuating member transitions between the first position and the second position in response to a pressure differential between the flow passage and an environment disposed outside of the bit body.

4. The drill bit of claim 1, wherein the radially outer surface of the actuating member slidingly engages the sleeve.

5. The drill bit of claim 1, wherein the fluid flow port extends along an axis of flow oriented at an acute angle relative to the central axis.

6. The drill bit of claim 1, wherein the throughbore of the actuating member includes a converging-diverging nozzle axially positioned between an uphole end of the actuating member and the fluid flow port.

7. The drill bit of claim 6, wherein the actuating member is configured to transition between the first position and the second position in response to a pressure drop across the converging-diverging nozzle.

8. A drill bit for drilling a borehole in a subterranean formation, the drill bit comprising:

a bit body having a central axis, a first end, a second end opposite the first end, and an outer surface extending from the first end to the second end, wherein the bit body includes a central flow passage extending axially from the first end, a first fluid flow bore extending from the central flow passage to the outer surface, and a second fluid flow bore extending from the central flow passage to the outer surface, wherein the second fluid flow bore is configured to supply drilling fluid to a cutting structure mounted to the second end of the bit body;

an actuating member movably disposed within the central flow passage, wherein the actuating member includes a throughbore, a radially outer surface, and a fluid flow port extending radially from the throughbore to the radially outer surface of the actuating member;

a biasing member axially positioned between the first end of the bit body and an annular flange on the radially outer surface of the actuating member, wherein the biasing member is configured to bias the bit body and the actuating member axially apart:

a sleeve fixably disposed within the central flow passage and radially positioned between the bit body and the actuating member, wherein the actuating member slidably engages the sleeve;

wherein the actuating member is configured to move axially relative to the bit body between a first position with the fluid flow port of the actuating member out of axial alignment with the first fluid flow bore of the bit body and a second position with the fluid flow port of the actuating member at least partially axially aligned with the first fluid flow bore of the bit body;

wherein the throughbore of the actuating member is configured to supply drilling fluid to the second fluid flow bore of the bit body but not the first fluid flow bore of the bit body with the actuating member in the first position, and wherein the throughbore of the actuating member is configured to supply drilling fluid to the first fluid flow bore of the bit body and the second fluid flow bore of the bit body with the actuating member in the second position.

9. The drill bit of claim 8, wherein the actuating member is axially biased to the first position.

10. The drill bit of claim 9, wherein the actuating member is configured to transition from the first position to the second position in response to a predetermined pressure differential between the throughbore of the actuating member and the first fluid flow bore of the bit body.

11. The drill bit of claim 9, wherein the actuating member is configured to transition from the first position to the second position in response to a predetermined flow rate of drilling fluid through the throughbore of the actuating member.

12. The drill bit of claim 11, wherein the throughbore of the actuating member includes a converging-diverging nozzle.

13. The drill bit of claim 8, wherein the sleeve includes an aperture in fluid communication with the first fluid flow bore of the bit body.

14. A method for drilling a borehole in a subterranean formation, the method comprising:

(a) rotating a drill bit about a central axis, the drill bit including a bit body having a first end, a second end opposite the first end, a radially outer surface, a flow passage extending axially from the first end, and a cutting structure disposed at the second end;

(b) flowing drilling fluid through the flow passage of the bit body during (a):

(c) axially moving an actuating member to a first position within the flow passage, wherein the actuating member includes a throughbore, a radially outer surface, and a fluid flow port extending radially from the throughbore to the radially outer surface of the actuating member;

(d) restricting fluid communication between the throughbore and the borehole through the fluid flow port during (c);

(e) axially moving the actuating member to a second position within the flow passage that is axially spaced from the first position; and (f) allowing fluid communication between the throughbore and the borehole throughbore the first flow port during (e)

wherein the throughbore of the actuating member includes a converging-diverging nozzle;

wherein (c) further comprises decreasing a flow rate of drilling fluids flowing through flow passage and decreasing a pressure differential across the converging-diverging nozzle; and wherein (e) further comprises increasing the flow rate of drilling fluids flowing through flow passage and increasing the pressure differential across the converging-diverging nozzle.

15. The method of claim 14, wherein (c) comprises decreasing a pressure differential between the throughbore and the borehole; and wherein (e) comprises increasing the pressure differential between the flow passage and the borehole.

16. The method of claim 15, further comprising axially biasing the actuating member toward the first position and away from the second position.

17. The method of claim 14, wherein the bit body further includes a first flow bore extending from the flow passage to the radially outer surface;

wherein (d) comprises axially misaligning the fluid flow port with the first flow bore; and wherein (f) comprises at least partially axially aligning the fluid flow port with the first flow bore.

* * * * *